US008230581B1

(12) United States Patent
Wilcoxon et al.

(10) Patent No.: US 8,230,581 B1
(45) Date of Patent: Jul. 31, 2012

(54) METHOD FOR PRODUCING A MULTI-BAND CONCENTRIC RING ANTENNA

(75) Inventors: Ross K. Wilcoxon, Cedar Rapids, IA (US); John C. Mather, Cedar Rapids, IA (US); Wajih A. El Sallal, Cedar Rapids, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 395 days.

(21) Appl. No.: 12/456,969

(22) Filed: Jun. 25, 2009

(51) Int. Cl.
*H01P 11/00* (2006.01)

(52) U.S. Cl. ..... 29/600; 29/592.1; 343/700 MS

(58) Field of Classification Search ..... 29/600, 29/592.1; 343/762–764, 772–775
See application file for complete search history.

(56) References Cited

U.S. PATENT DOCUMENTS 5,633,105 A * 5/1997 Jensen et al. ..... 430/18
5,907,797 A * 5/1999 Hanatatsu et al. ..... 455/115.2
5,963,169 A * 10/1999 Anderson et al. ..... 343/701
6,624,719 B1 * 9/2003 Anderson et al. ..... 333/99 PL
6,720,932 B1 * 4/2004 Flynn et al. ..... 343/786
6,992,630 B2 * 1/2006 Parsche ..... 343/700 MS
7,102,581 B1 9/2006 West

* cited by examiner

*Primary Examiner* — Minh Trinh
(74) *Attorney, Agent, or Firm* — Donna P. Suchy; Daniel M. Barbieri

(57) ABSTRACT

The present disclosure includes a method for producing a multi-band waveguide reflector antenna feed. The antenna feed includes a first tube and a second tube. The first and second tubes are connected to form a concentric multi-band waveguide feed array. The first tube includes a surface(s) which is/are at least partially covered by metamaterial(s), thereby forming a first waveguide feed. The second tube also includes a surface(s) which is/are at least partially covered by metamaterial(s). A radial separation is established between the first tube and the second tube, thereby forming a second waveguide feed. The radial separation may be maintained between the first tube and the second tube by one or more of: a loading material, support structures, strings, and wires. The loading material, support columns, strings, and/or wires also structurally interconnect the first tube and the second tube.

11 Claims, 8 Drawing Sheets

METHOD FOR PRODUCING A MULTI-BAND CONCENTRIC RING ANTENNA

FIELD OF THE INVENTION

The present invention relates to the field of advanced radio systems and particularly to robust packaging of a multiband/multi-band concentric ring antenna.

BACKGROUND OF THE INVENTION

Current antennas may not provide a desired level of performance.

Thus, it would be desirable to provide an antenna which obviates problems associated with current solutions.

SUMMARY OF THE INVENTION

Accordingly, an embodiment of the present invention is directed to a method for producing a multi-band waveguide reflector antenna feed, including: providing a first tube; applying metal to a first surface of the first tube; patterning the metal on the first surface of the first tube to form a metamaterial structure/metamaterial on the first surface of the tube; providing a first flexible substrate; applying metal to the first flexible substrate; patterning the metal on the first flexible substrate to form a metamaterial structure/metamaterial on the first flexible substrate; bonding the first flexible substrate to a second surface of the first tube to form a first waveguide feed of the multi-band waveguide reflector antenna feed; providing a second tube; providing a second flexible substrate; applying metal to the second flexible substrate; patterning the metal on the second flexible substrate to form a metamaterial structure/metamaterial on the second flexible substrate; bonding the second flexible substrate to a surface of the second tube; and positioning the first tube and the second tube in a concentric array, thereby forming the second waveguide feed of the multi-band waveguide reflector antenna feed, said positioning including: selecting and establishing a relative radial positioning for the first tube and the second tube, wherein said relative radial positioning is selected and established based on desired frequency characteristics for the first waveguide feed and the second waveguide feed, the relative radial positioning providing a radial separation between the first tube and the second tube, thereby forming a cavity between the first tube and the second tube. Further, the method may include: at least partially filling the cavity formed between the first tube and the second tube with a loading material for structurally interconnecting the first tube and the second tube and for maintaining the radial separation between the first tube and the second tube, thereby forming the multi-band waveguide reflector antenna feed; and/or structurally interconnecting the first tube and the second tube via a plurality of support structures, thereby forming the multi-band waveguide reflector antenna feed, wherein said plurality of support structures maintains the radial separation between the first tube and the second tube.

An additional embodiment of the present invention is directed to a method for producing a multi-band waveguide reflector antenna feed, including: providing a first tube; applying metal to a first surface of the first tube; patterning the metal on the first surface of the first tube to form a metamaterial structure/metamaterial on the first surface of the first tube; providing a first flexible substrate; applying metal to the first flexible substrate; patterning the metal on the first flexible substrate to form a metamaterial on the first flexible substrate; bonding the first flexible substrate to a second surface of the first tube to form a first waveguide feed of the multi-band waveguide reflector antenna feed; providing a second flexible substrate; applying metal to the second flexible substrate; patterning the metal on the second flexible substrate to form a metamaterial structure/metamaterial on the second flexible substrate; shaping the second flexible substrate to form a second tube; and positioning the second tube at least partially around the first tube in a concentric array, thereby forming the second waveguide feed of the multi-band waveguide reflector antenna feed, said positioning including: selecting and establishing a relative radial positioning for the first tube and the second tube, wherein said relative radial positioning is selected and established based on desired frequency characteristics for the first waveguide feed and the second waveguide feed, the relative radial positioning providing a radial separation between the first tube and the second tube, thereby forming a cavity between the first tube and the second tube. Further, the method may include: at least partially filling the cavity formed between the first tube and the second tube with a loading material for structurally interconnecting the first tube and the second tube and for maintaining the radial separation between the first tube and the second tube, thereby forming the multi-band waveguide reflector antenna feed; and/or structurally interconnecting the first tube and the second tube via a plurality of support structures, thereby forming the multi-band waveguide reflector antenna feed, wherein said plurality of support structures maintains the radial separation between the first tube and the second tube.

A further embodiment of the present invention is directed to a multi-band waveguide reflector antenna feed, including: a first tube, the first tube including a plurality of surfaces, at least one surface included in the plurality of surfaces being at least partially covered by a first metamaterial, thereby forming a first waveguide feed; and a second tube, the second tube being connected to the first tube, the second tube including a plurality of surfaces, at least one surface included in the plurality of surfaces of the second tube being at least partially covered by a second metamaterial, the first tube and the second tube being established as a concentric array wherein the second tube is positioned at least partially around the first tube, thereby forming a second waveguide feed, wherein a radial separation is established between the first tube and the second tube, said radial separation being maintained via one of: a loading material disposed within a cavity formed between the first tube and the second tube; and support structures configured for structurally interconnecting the first tube and the second tube.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Modern communications systems which enable high speed mobile multimedia networking may demand multiple frequency bands. These modern communications systems may also demand higher data rates than previous communications systems. In conventional implementations, a communications system which demands multiple frequency bands may implement multiple antennas to address the needs of individual frequency bands included in those multiple frequency bands. The resulting array of multiple antennas may adversely impact the cost, size and/or weight of the overall communications system. Therefore, it may be advantageous to provide a communications system which implements an integrated antenna configuration (ex.—single aperture) that may operate over multiple frequency bands (ex.—operates as a multi-band antenna).

A first method/solution for achieving multi-band antenna capability may be to utilize a parabolic reflector with a multiple feed structure, wherein each feed supports a unique frequency band. A drawback to this first solution is that it relies on expensive and complex diplexers or manually-swapped feeds/feed structures to support individual operating bands/frequency bands. Further drawbacks to this first solution are that it is inefficient (ex.—time-consuming) and heavy/cumbersome.

Figure 1B:
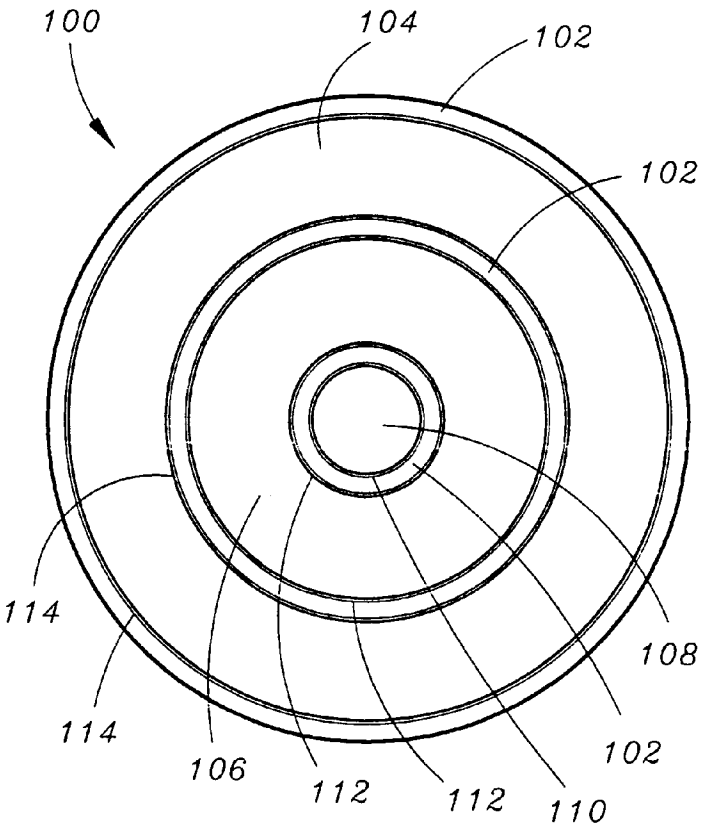
FIGS. 1A and 1B are perspective and end views respectively of a multi-band antenna feed in accordance with an exemplary embodiment of the present invention.
Figure 1A:
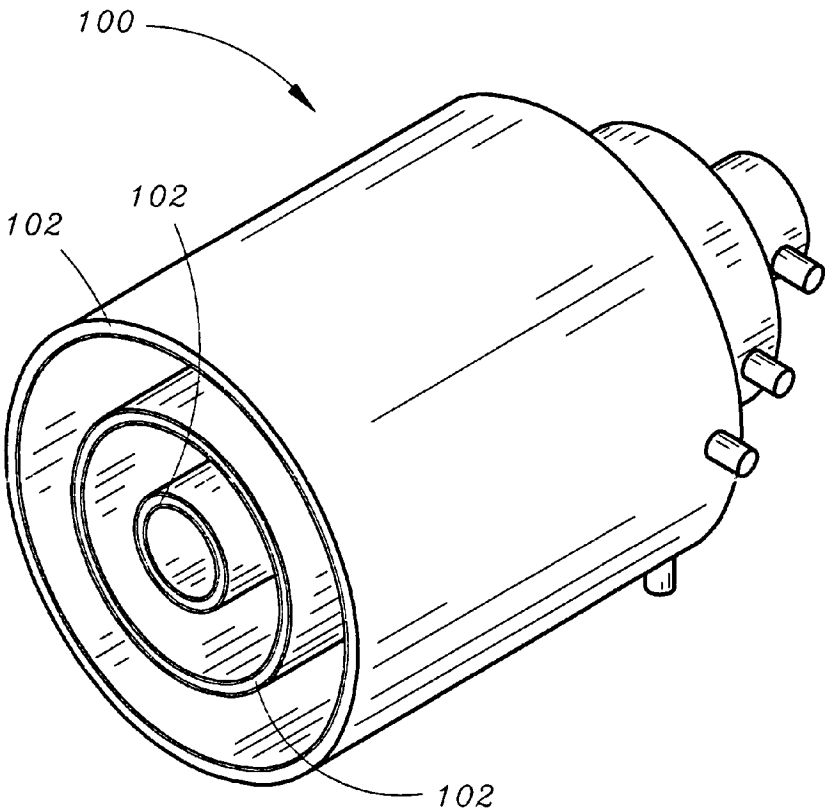

Alternatively, a Multi-band Concentric Ring Metamaterial Reflector Feed (MCRMRF) may be implemented to support multiple bands (ex.—Satellite Communications (SATCOM) bands) via a simple physical architecture. For instance, the MCRMRF may extend multi-band feed concepts as described in U.S. Pat. No. 7,102,581 entitled: "Multiband Waveguide Antenna Reflector Feed" which is herein incorporated by reference in its entirety. The MCRMRF is based on the concept of implementing metamaterials on two or more concentric or co-axial surfaces. These metamaterials may simulate an artificial electromagnetic boundary condition which defines the frequency of the waveguide formed by the volume made up of these surfaces. A physical representation of the multi-band antenna feed (ex.—MCRMRF)/MCRMRF concept is shown in FIGS. 1A and 1B. The MCRMRF 100 may include a plurality of concentric tubes 102 with metamaterials on one or both surfaces of the outer tubes to establish multiple waveguides 104 (band 3 waveguide), 106 (band 2 waveguide), and 108 (band 1 waveguide). For example, FIG. 1B shows the band 1 waveguide metamaterial(s) 110, the band 2 waveguide metamaterial(s) 112, and the band 3 waveguide metamaterial(s) 114. The band 2 waveguide metamaterial(s) 112 and the band 3 waveguide metamaterial(s) 114 may not necessarily have the same metamaterial properties. Each waveguide may be realized by a rectangular, cylindrical or any arbitrary shape, and may operate at a specific frequency. The combination of metamaterial properties and tube geometries may establish a distinct frequency, a set of frequencies, or a frequency band over which the antenna feed would operate.

A key to implementing the MCRMRF concept in a physically realizable device may be via mechanical packaging of the concentric tubes in a robust manner. Many of the applications which may have the greatest need for multiband antenna capability are on platforms, such as Unmanned Aerial Vehicles (UAVs), which are often exposed to harsh environmental conditions. Thus, the present invention provides a method for mechanically packaging a concentric surface multi-band antenna feed (ex.—a multi-band feedhorn for a parabolic dish antenna for use in UAVs) which is small (ex.—in size and weight), cost-effective, mechanically robust and realizes improved performance for multi-band capabilities.

Figure 2B:
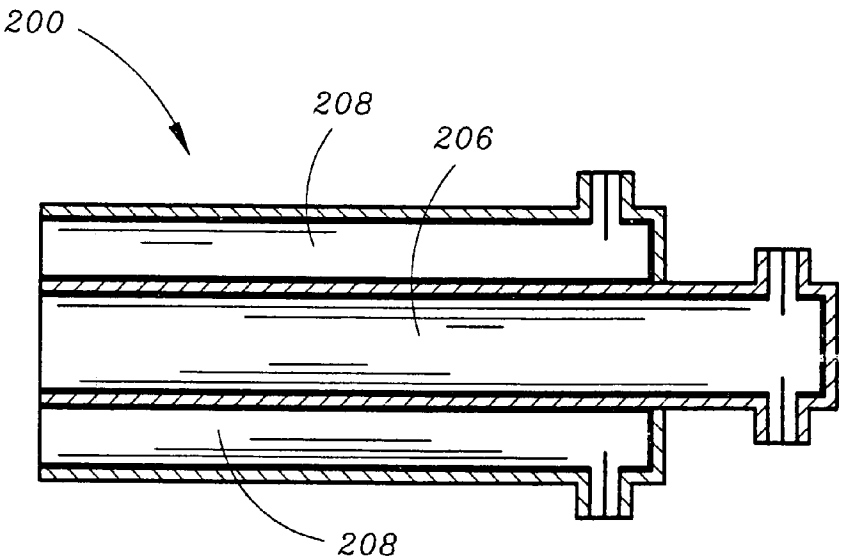
FIGS. 2A and 2B are perspective and cutaway views respectively of a dual-band antenna feed in accordance with a further exemplary embodiment of the present invention.
Figure 2A:
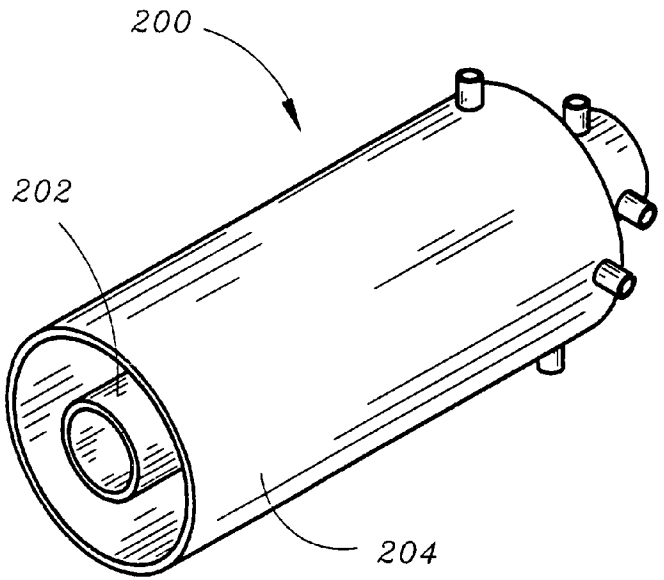

A conceptual multi-band antenna feed 200 is shown in FIGS. 2A and 2B, The feed 200 may include two concentric tubes 202, 204 and may be a Multi-Band Concentric Ring Metamaterial Reflector Feed (MCRMRF) which allows dual band operation. For example, a waveguide for a first band (ex.—a Band 1 waveguide) 206 may be defined by the geometry and inner surface properties of the inner tube 202. Further, a waveguide for a second band (ex.—a Band 2 waveguide) 208 may be defined by both tube geometries and the metamaterial properties on the outside of the inner tube 202 and/or the inside of the outer tube 204. Two keys to physically realizing the antenna feed/system 200 shown in FIGS. 2A and 2B are: 1) accurate patterning of metamaterials on the inner and/or outer surfaces of the concentric tubes; and 2) structurally supporting the concentric tubes to form the antenna feed waveguides. The present invention provides mechanically robust MCRMRF embodiments and methods for providing same.

Figure 3A:
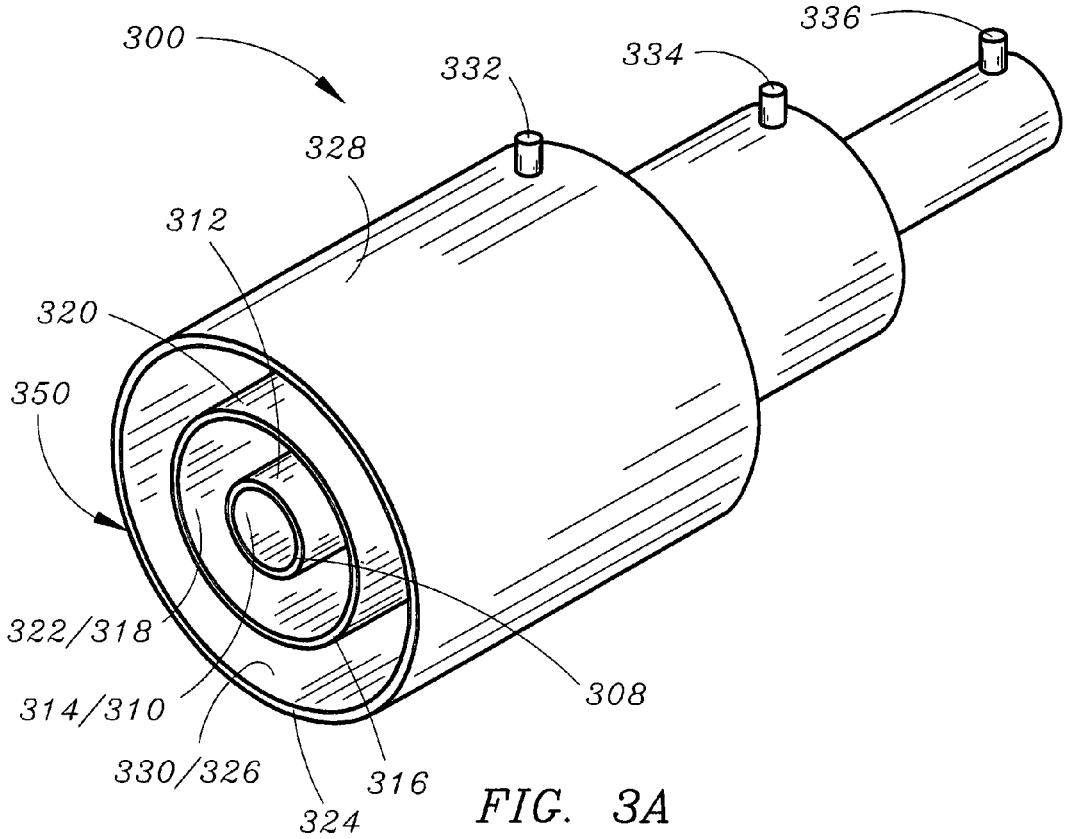
FIGS. 3A and 3B are perspective and end views respectively of a multi-band antenna feed in accordance with a further exemplary embodiment of the present invention.
Figure 3B:
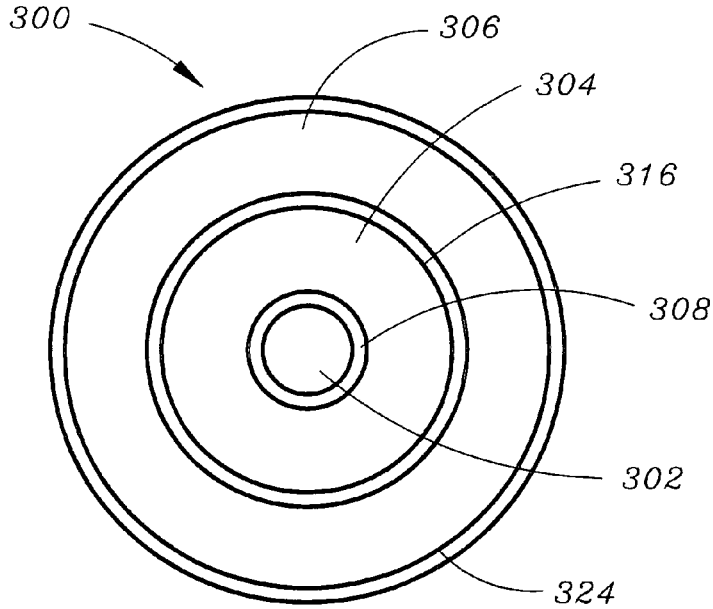

Referring to FIGS. 3A and 3B, a multiple-band (ex.—multi-band) waveguide reflector antenna feed in accordance with an exemplary embodiment of the present invention is shown. In a current embodiment of the present invention, the multi-band waveguide reflector antenna feed 300 includes a plurality of waveguide feeds, such as a first waveguide feed 302, a second waveguide feed 304 and a third waveguide feed 306. The waveguide feeds 302, 304, 306 may be configured as a concentric multi-band waveguide feed array (as shown in FIGS. 3A and 3B). The first waveguide feed 302 may include a first tube 308. For example, the first tube 308 may be a pre-formed tube, such as an elongated cylindrically-shaped body, a polygonal cross-section, or the like. Further, the first tube 308 may include a first surface (ex.—an interior surface) 310 and a second surface (ex.—an exterior surface) 312. In exemplary embodiments, the second surface/exterior surface 312 of the first tube 308 may be at least partially covered/plated with one or more metal structures/metals. For example, the metal structure(s)/metal(s) may include one or more layer(s)/material(s), such as metal layer(s)/material(s), dielectric layer(s)/material(s), and/or the like. Further, the metal structures/metals may be patterned on the exterior surface 312 of the first tube 308 in such a manner, such as via a chemical etching process, laser ablation, and/or the like to form a metamaterial structure/metamaterial.

In further embodiments, the first tube 308 may include a flexible substrate 314. The flexible substrate 314 may include a plurality of surfaces. One or more surfaces of the flexible substrate 314 may be at least partially covered/plated with one or more metal structures/metals. For example, the metal structure(s)/metal(s) may include one or more layer(s)/material(s), such as metal layer(s)/material(s), dielectric layer(s)/material(s), and/or the like. Further, the metal structure(s)/metal(s) may be patterned on the flexible substrate 314 to form a metamaterial structure/metamaterial. Still further, the flexible substrate 314 may be attached to/shaped to/bonded to the first surface/interior surface 310, thereby forming the first waveguide feed 302 of the multi-band waveguide reflector antenna feed 300.

In additional embodiments, the multi-band waveguide reflector antenna feed 300 may include a second tube 316. For example, the second tube 316 may be a pre-formed tube, such as an elongated cylindrically-shaped body, a polygonal cross-section, or the like. Further, the second tube 316 may include a first surface (ex.—an interior surface) 318 and a second surface (ex.—an exterior surface) 320. In exemplary embodiments, the second surface/exterior surface 320 of the second tube 316 may be at least partially covered/plated with one or more metal structures/metals (ex.—may be metallized). For example, the metal structure(s)/metal(s) may include one or more layer(s)/material(s), such as metal layer(s)/material(s), dielectric layer(s)/material(s), and/or the like. Further, the metal structures/metals may be patterned on the exterior surface 320 of the second tube 316 to form a metamaterial structure/metamaterial.

In further embodiments, the second tube 316 may include a flexible substrate 322. The flexible substrate 322 may include a plurality of surfaces. One or more surfaces of the flexible substrate 322 may be at least partially covered/plated with one or more metal structures/metals. For example, the metal structure(s)/metal(s) may include one or more layer(s)/material(s), such as metal layer(s)/material(s), dielectric layer(s)/material(s), and/or the like. Further, the metal structure(s)/metal(s) may be patterned on the flexible substrate 322 to form a metamaterial structure/metamaterial. Still further, the flexible substrate 316 may be attached to/shaped to/bonded to the first surface/interior surface 318 of the second tube 316, thereby forming the second waveguide feed 304 of the multi-band waveguide reflector antenna feed 300.

In additional embodiments, the multi-band waveguide reflector antenna feed 300 may further include a third tube 324. For instance, the third tube 324 may be a pre-formed tube, such as an elongated cylindrically-shaped body, a polygonal cross-section, or the like. Further, the third tube 324 may include a first surface (ex.—an interior surface) 326 and a second surface (ex.—an exterior surface) 328. In exemplary embodiments, the third tube 324 may include a flexible substrate 330. The flexible substrate 330 may include a plurality of surfaces. One or more surfaces of the flexible substrate 330 may be at least partially covered/plated with one or more metal structures/metals. Further, the metal structure(s)/metal(s) may be patterned on the flexible substrate 330 to form a metamaterial structure/metamaterial. Still further, the flexible substrate 330 may be attached to/shaped to/bonded to the first surface/interior surface 326 of the third tube 324, thereby forming the third waveguide feed 306 of the multi-band waveguide reflector antenna feed 300.

As described above, one or more of the tubes (308, 316 and/or 324) of the feed 300 may be pre-formed/pre-fabricated and may have flexible substrates (314, 322, 330) bonded to/attached to/shaped to/combined with their interior surfaces (310, 318, 326). In alternative embodiments, one or more of the tubes (308, 316 and/or 324), rather than being pre-formed and having a flexible substrate bonded to them, may be a flexible substrate formed as a tube(s).

In further embodiments, one or more electrical connectors/ports (332, 334, 336) may be connected to the tubes (308, 316, 324) via which electrical inputs/electrical feeds may be provided to the waveguide feeds (302, 304, 306). For example, the ports (332, 334, 336) may be waveguide-to-coax transitions for feeding the waveguide feeds (302, 304, 306). In exemplary embodiments, the tubes (308, 316, 324) may be of unequal lengths, such as to meet frequency requirements of the waveguide feeds/waveguides (302, 304, 306) and/or to promote ease of access to the electrical connectors (332, 334, 336) which may provide ports for discrete frequencies.

In exemplary embodiments, as shown in FIGS. 3A and 3B, the waveguide feeds/waveguides (302, 304, 306) may be/may include concentric surfaces/concentric waveguides/circular waveguides. For example, the first waveguide feed 302 may be a waveguide feed configured for operating over a first frequency/first set of frequencies/first frequency band (ex.—a Band 1 waveguide feed) disposed in the center of the multi-band waveguide reflector antenna feed 300, the interior surface 310 of the tube 308 of the Band 1 waveguide feed 302 acting as an outer conductor of the Band 1 waveguide feed. Further, the second waveguide feed 304 may be a waveguide feed configured for operating over a second frequency/second set of frequencies/second frequency band (ex.—a Band 2 waveguide feed) disposed in a concentric ring around the Band 1 waveguide feed 302. The Band 2 waveguide feed 304 may operate as a coaxial waveguide with the exterior surface 312 of the tube 308 of the Band 1 waveguide feed 302 serving as an inner conductor for the Band 2 waveguide 304 and the interior surface 318 of the tube 316 of Band 2 waveguide 304 serving as an outer conductor for the Band 2 waveguide 304. Further, the third waveguide feed 306 may be a waveguide feed configured for operating over a third frequency/third set of frequencies/third frequency band (ex.—a Band 3 waveguide feed) disposed in a concentric ring around the Band 2 waveguide feed 304. The Band 3 waveguide feed 306 may act as a coaxial waveguide with the exterior surface 320 of the tube 316 of the Band 2 waveguide feed 304 serving as an inner conductor for the Band 3 waveguide 306 and the interior surface of the tube 324 of the Band 3 waveguide 306 serving as an outer conductor for the Band 3 waveguide. In alternative embodiments, the multi-band waveguide reflector antenna feed 300 may include a differently shaped array of waveguides (ex.—rectangular waveguides) and/or may include a larger or smaller number of waveguides than the embodiment shown in FIGS. 3A and 3B.

As mentioned above, each of the metamaterial structures/metamaterials which are created/formed/implemented on the concentric or co-axial surfaces of the multi-band waveguide reflector antenna feed 300 may simulate an artificial electromagnetic boundary condition which defines the frequency of the waveguides formed by the volumes made up of these surfaces. Further, the same or different types of metal structures/metals may be applied to the respective surfaces of the multi-band waveguide reflector antenna feed/assembly 300 and the same or different types of metamaterial structures/metamaterials may be formed on the respective surfaces of the multi-band waveguide reflector antenna feed/assembly 300 depending on the desired characteristics of the feed/assembly 300.

In further embodiments, the waveguide feeds (302, 304, 306)/tubes (308, 316, 324) may be connected/structurally interconnected to each other. In exemplary embodiments of the multi-band waveguide reflector antenna feed 300, relative radial positioning may be established for the waveguides (302, 304, 306)/tubes (308, 316, 324) such that a radial separation may be established between the first waveguide feed 302/first tube 308 and the second waveguide 304/second tube 316, such that a cavity is formed between the first tube 308 and the second tube 316. Further, a radial separation may also be established between the second waveguide 304/second tube 316 and the third waveguide 306/third tube 324, such that a cavity is formed between the second tube 316 and the third tube 324. The radial separation(s) may be established as desired to provide/establish suitable frequency characteristics for the waveguide(s) (302, 304 and/or 306).

In additional embodiments, metamaterial structures/metamaterial(s) may be formed on surfaces of the multi-band waveguide reflector antenna feed/assembly 300 by: creating a pattern (such as with a photoresist); metallizing the surface(s); and then employing a lift-off process. In further embodiments, the multi-band waveguide reflector antenna feed/assembly 300 may form a feed aperture 350 where/from which each of the multiple bands (ex.—Bands 1, 2 and 3) may radiate at all polarizations, thereby allowing for monopulse operations.

Figure 4A:
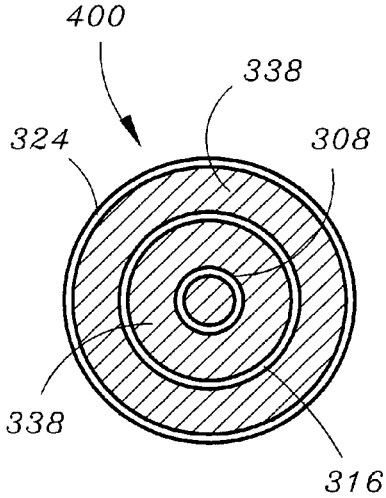
FIGS. 4A and 4B are end and perspective views respectively of a multi-band antenna feed which includes/implements loading material in accordance with a further exemplary embodiment of the present invention.
Figure 4B:
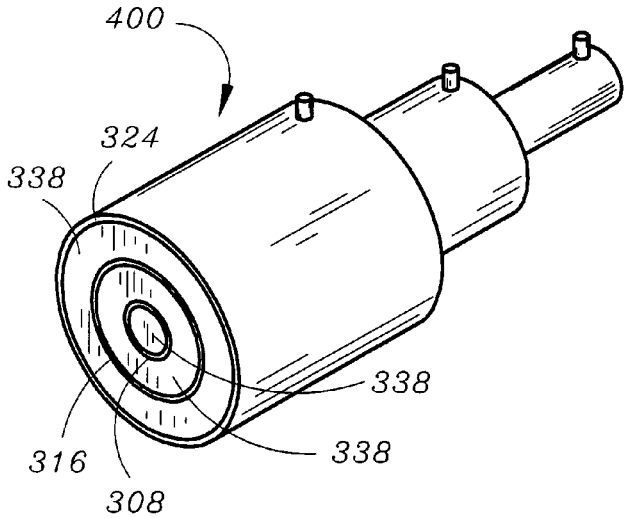

In exemplary embodiments of the present invention, as shown in FIGS. 4A and 4B, a multi-band waveguide reflector antenna feed/assembly 400 may include a loading material(s) 338 which may be configured within/may at least partially fill one or more of the cavities formed between the tubes (308, 316, 324) for maintaining the above-referenced radial separation between the tubes (308, 316, 324). The loading material may be a structural polymer(s), a dielectric material(s) and/or a dielectric structural foam which may adhesively bond to the surfaces of the tubes (308, 316, 324) for structurally interconnecting the tubes (308, 316, 324)/structurally supporting the concentric waveguides (302, 304, 306) without negatively impacting antenna performance/performance of the antenna feed/assembly 300. For instance, during fabrication of the multi-band waveguide reflector antenna feed/assembly 400, the tubes/rings (308, 316, 324) may be mechanically constrained, then the cavities may be filled by the loading material 338. In further exemplary embodiments, the innermost tube 308 may form a cavity and said cavity formed by the innermost tube 308 may or may not include loading material(s) 338, depending upon strength of the tube 308 and/or properties of the loading material(s) (ex.—foam) 338.

Figure 5A:
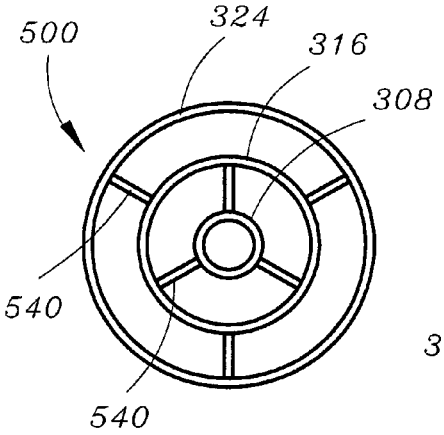
FIGS. 5A and 5B are end and perspective views respectively of a multi-band antenna feed which includes/implements support columns for maintaining radial separation between the tubes of the antenna feed in accordance with a further exemplary embodiment of the present invention.
Figure 5B:
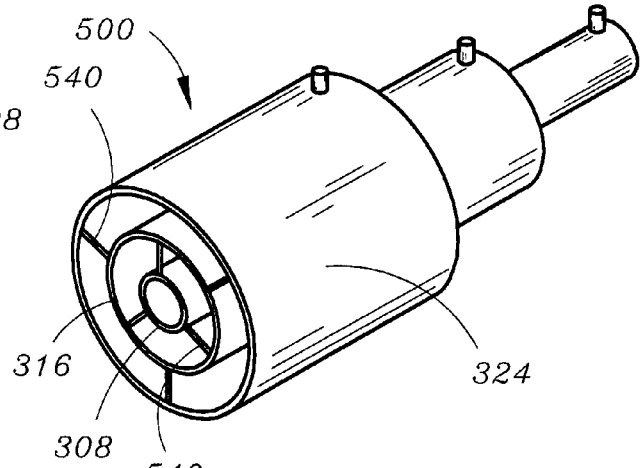
Figure 6A:
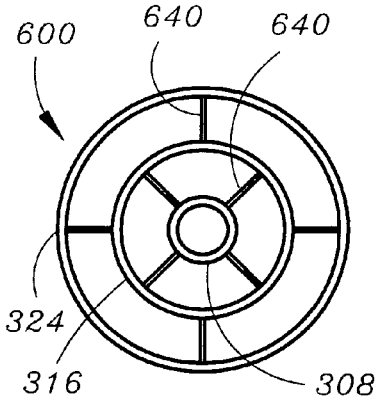
FIGS. 6A and 6B are end and perspective views respectively of a multi-band antenna feed which includes/implements thin wires for maintaining radial separation between the tubes of the antenna feed in accordance with a further exemplary embodiment of the present invention.
Figure 6B:
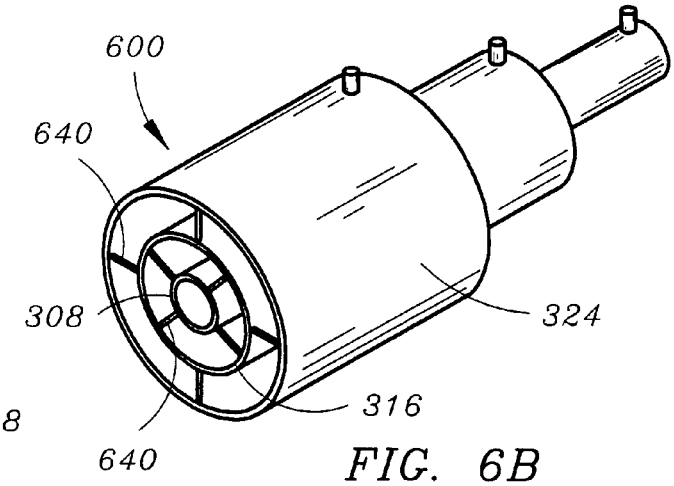

In current embodiments of the present invention, as shown in FIGS. 5A, 5B, 6A and 6B, the multi-band waveguide reflector antenna feed/assembly 500, 600 may include a plurality of support structures 540, 640 (ex.—internal columns, strings, high aspect ratio columns, wires, etc.) configured for maintaining the above-referenced radial separation between the tubes (308, 316, 324). For example, the support structures 540, 640 may be radially-oriented and may be established at a plurality of locations along surface(s) of the first tube 308, the second tube 316 and/or the third tube 324 for structurally interconnecting the first tube 308/first waveguide feed 302, the second tube 316/second waveguide feed 304, and/or the third tube 324/the third waveguide feed 306. In exemplary embodiments of the present invention, as shown in FIGS. 5A and 5B, the support structures 540 may be dielectric loaded radial columns or strings which may be integrated at discrete points along the length(s) of the tube(s) (308, 316, 324)/waveguide feed(s) (302, 304, 306) for maintaining proper radial separation between the tubes/waveguide feeds. In alternative embodiments of the present invention, as shown in FIGS. 6A and 6B, the support structures 640 may be thin wires or strings oriented radially along the waveguides/waveguide feeds (302, 304, 306) and may be held in tension in a bicycle spoke-like configuration. Because the wires/strings 640 may be held in tension rather than compression, said wires/strings may be much thinner than the columns, and thus, may potentially have less negative impact on waveguide performance.

Figure 7A:
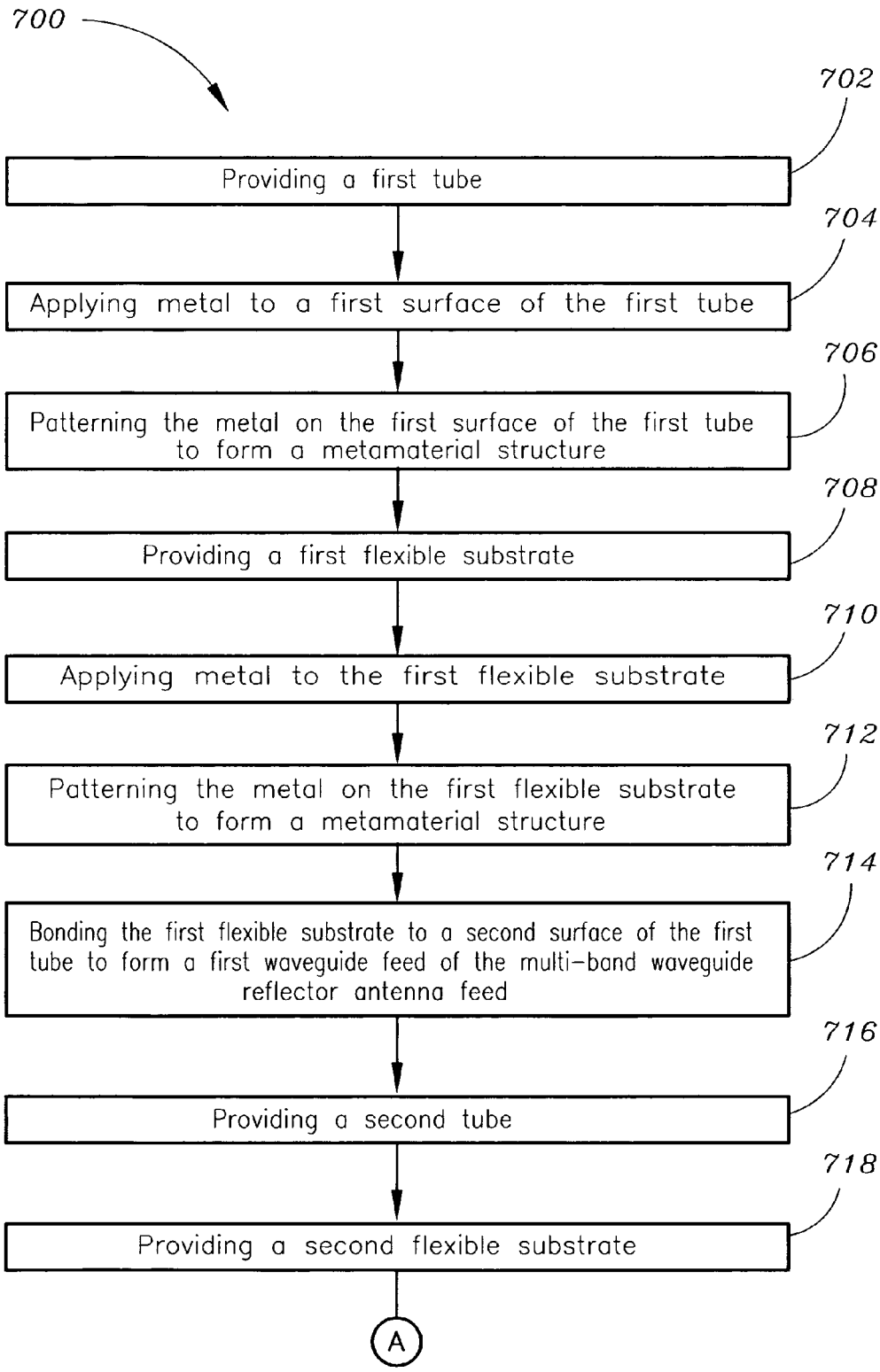
FIG. 7 is a flowchart illustrating a method for producing a multi-band waveguide reflector antenna feed in accordance with an additional exemplary embodiment of the present invention.
Figure 7B:
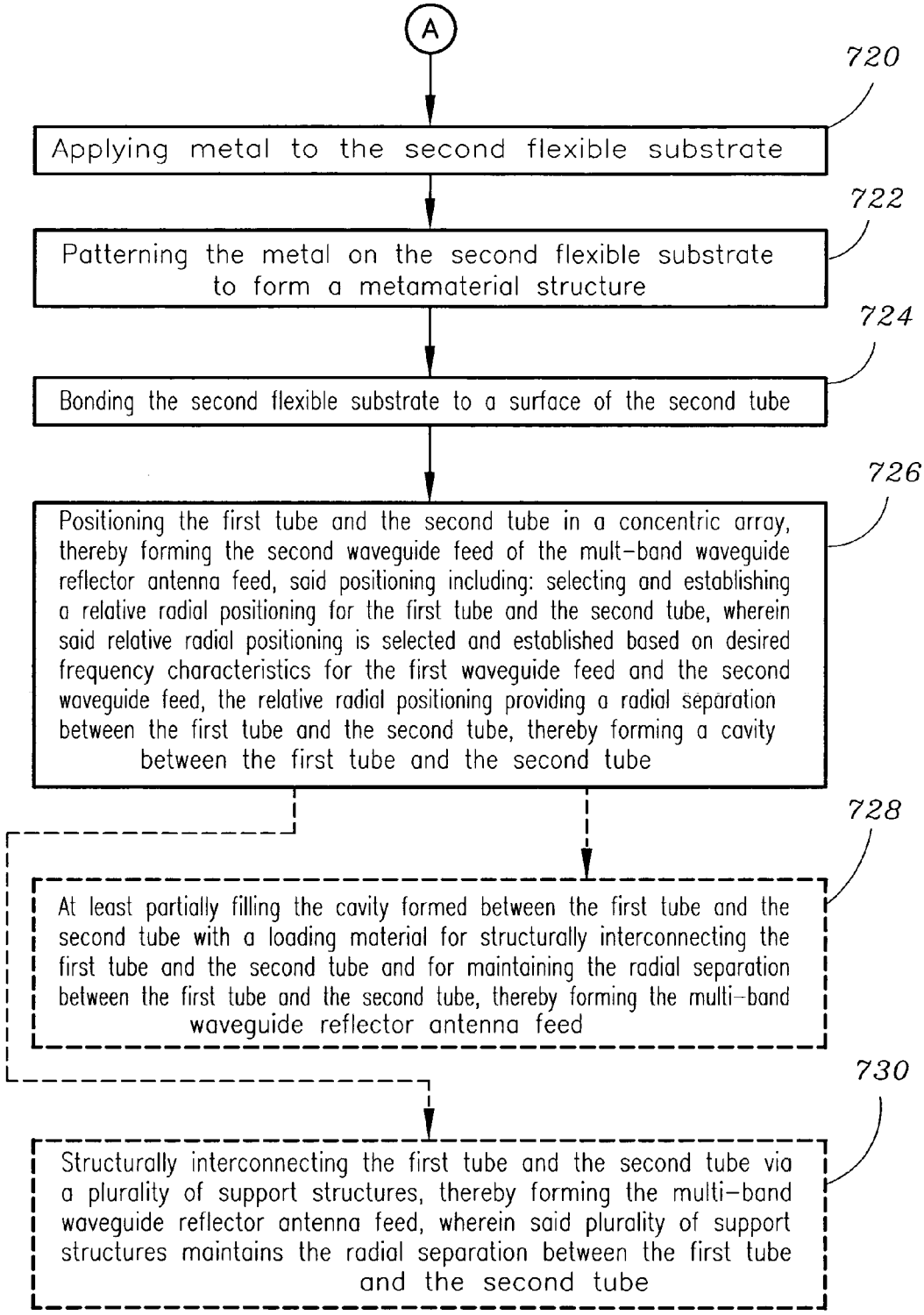

FIG. 7 is a view of a flowchart illustrating a method for producing a multi-band waveguide reflector antenna feed in accordance with an exemplary embodiment of the present invention. The method 700 may include the step of providing a first tube 702. For example, the first tube may be a preformed tube, such as an elongated cylindrically-shaped body, a polygonal cross-section, or the like. The method 700 may further include applying a metal structure/metal to a first surface of the first tube 704. For instance, the first surface may be at least partially plated with the metal structure/metal. Further, the metal structure may include one or more layer(s)/material(s), such as metal layer(s)/material(s), dielectric layer(s)/material(s), and/or the like.

The method 700 may further include patterning the metal structure/metal to form a metamaterial structure/metamaterial on the first surface of the first tube 706. For instance, patterning the metal structure/metal to form a metamaterial structure/metamaterial on the first surface of the first tube may be achieved via a chemical etching process, laser ablation, or the like. Metamaterial properties of the metamaterial on the first surface of the first tube may be defined via the above-referenced application step 704 and patterning step 706.

The method 700 may further include providing a first flexible substrate 708. The method 700 may further include applying a metal structure/metal to a surface (ex.—one or more surfaces) of the first flexible substrate 710. For instance, the surface of the first flexible substrate may be at least partially plated with the metal structure/metal. Further, the metal structure may include one or more layer(s)/material(s), such as metal layer(s)/material(s), dielectric layer(s)/material(s), and/or the like. In exemplary embodiments of the present application, the term flexible substrate may refer to materials having nominally uniform flexibility and/or substrates having non-uniform stiffness, such as rigid-flex circuit assemblies. The method 700 may further include patterning the metal structure/metal on the surface(s) of the first flexible substrate to form a metamaterial structure/metamaterial 712. For instance, patterning the metal structure/metal on the surface of the first flexible substrate may be achieved via a chemical etching process, laser ablation, or the like. Metamaterial properties of the metamaterial structure/metamaterial formed on the surface of the first flexible substrate may be defined via the above-referenced application step 710 and patterning step 712. In further embodiments, the method 700 may further include bonding the first flexible substrate to a second surface of the first tube to form a first waveguide feed of the multi-band waveguide reflector antenna feed 714.

The method 700 may further include providing a second tube 716. The method 700 may further include providing a second flexible substrate 718. The method 700 may further include applying a metal structure/metal to the second flexible substrate 720. For instance, the second flexible substrate may be at least partially plated with the metal structure/metal.

Further, the metal structure may include one or more layer(s)/material(s), such as metal layer(s)/material(s), dielectric layer(s)/material(s), and/or the like. The method 700 may further include patterning the metal structure/metal on the second flexible substrate to form a metamaterial structure/metamaterial 722. For instance, patterning the metal structure/metal on the second flexible substrate may be achieved via a chemical etching process, laser ablation, or the like. Metamaterial properties of the metamaterial structure/metamaterial formed on the surface of the second flexible substrate may be defined via the above-referenced application step 720 and patterning step 722. The method 700 may further include bonding the second flexible substrate to a surface of the second tube 724. The method 700 may further include positioning the first tube and the second tube in a concentric array, thereby forming the second waveguide feed of the multi-band waveguide reflector antenna feed, said positioning including: selecting and establishing a relative radial positioning for the first tube and the second tube, wherein said relative radial positioning is selected and established based on desired frequency characteristics for the first waveguide feed and the second waveguide feed, the relative radial positioning providing a radial separation between the first tube and the second tube, thereby forming a cavity between the first tube and the second tube 726.

In an exemplary embodiment, the method 700 may further include at least partially filling the cavity formed between the first tube and the second tube with a loading material for structurally interconnecting the first tube and the second tube and for maintaining the radial separation between the first tube and the second tube, thereby forming the multi-band waveguide reflector antenna feed 728. Alternatively, the method 700 may further include structurally interconnecting the first tube and the second tube via a plurality of support structures, thereby forming the multi-band waveguide reflector antenna feed, wherein said plurality of support structures (ex.—columns, wires, strings) maintains the radial separation between the first tube and the second tube 730.

Figure 8A:
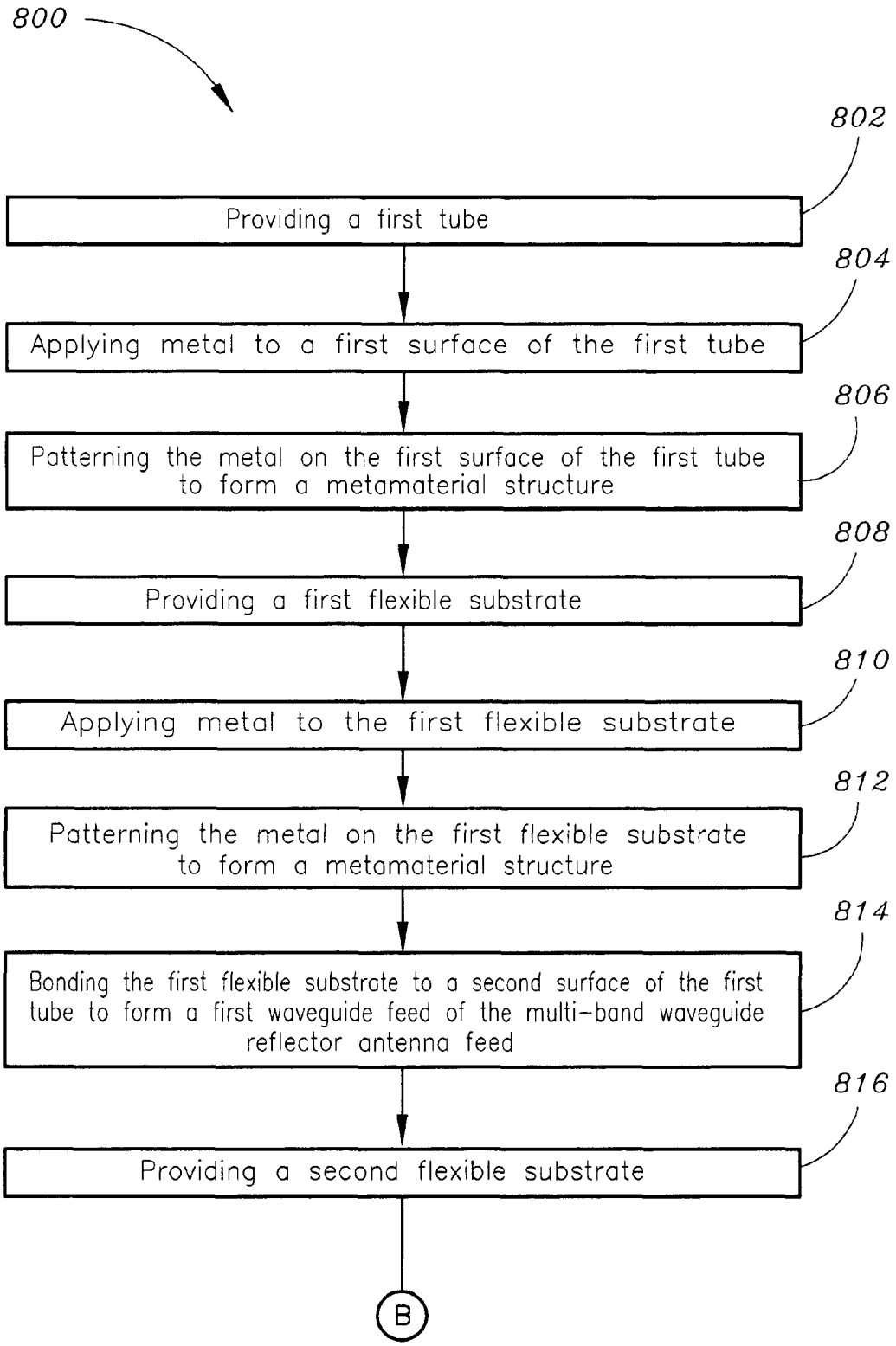
FIGS. 8A and 8B are a flowchart illustrating a method for producing a multi-band waveguide reflector antenna feed in accordance with an alternative exemplary embodiment of the present invention.
Figure 8B:
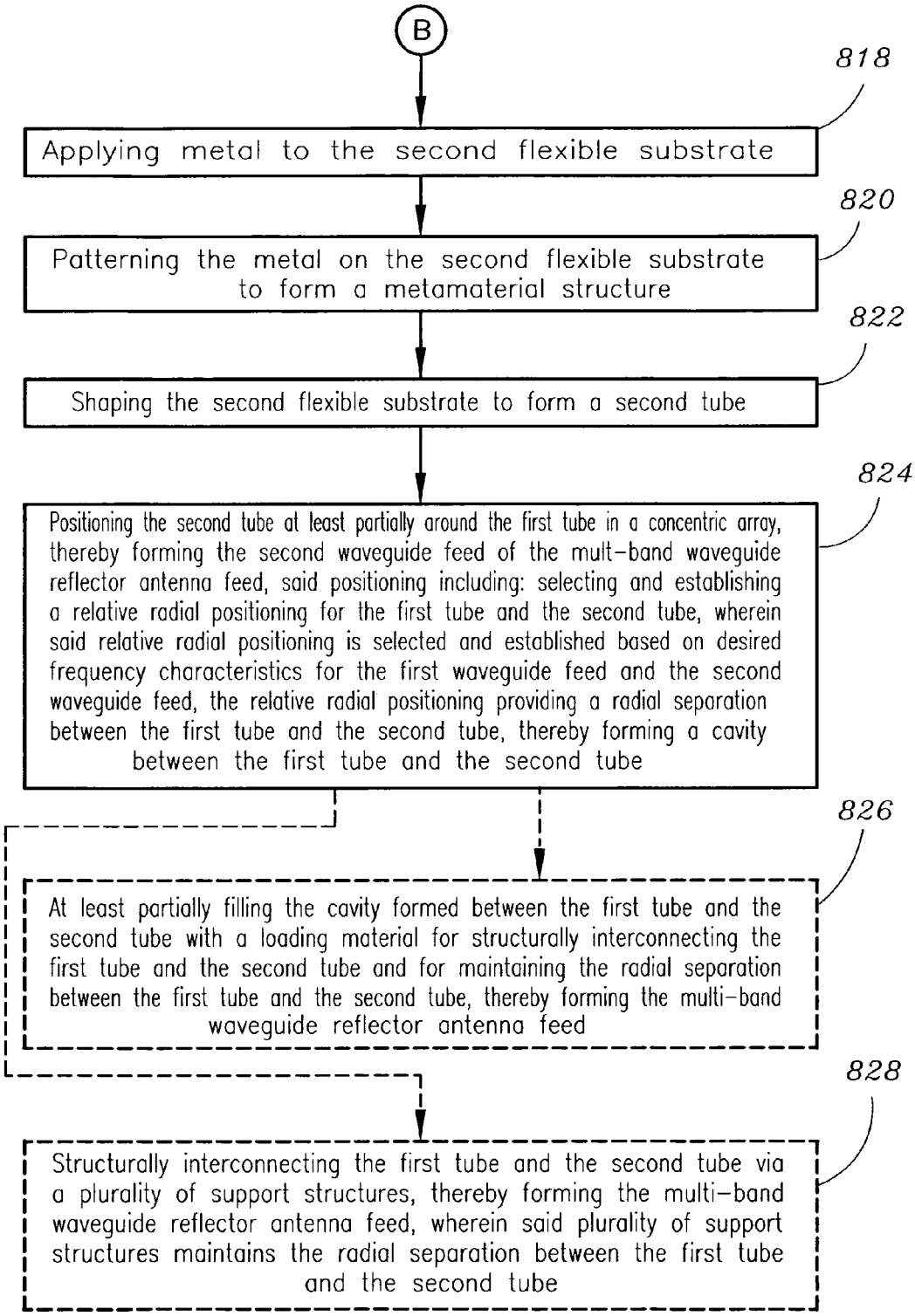

FIGS. 8A and 8B are a flowchart illustrating a method for producing a multi-band waveguide reflector antenna feed in accordance with an alternative embodiment of the present invention. The method 800 may include the step of providing a first tube 802. The method 800 may further include the step of applying a metal structure/metal to a first surface of the first tube 804. For instance, the first surface of the first tube may be at least partially plated with the metal structure/metal. Further, the metal structure may include one or more layer(s)/material(s), such as metal layer(s)/material(s), dielectric layer(s)/material(s), and/or the like. The method 800 may further include patterning the metal structure/metal on the first surface of the tube to form a metamaterial structure/metamaterial on the first surface of the first tube 806. For instance, patterning the metal structure/metal to form a metamaterial structure/metamaterial on the first surface of the tube may be achieved via a chemical etching process, laser ablation, or the like. Metamaterial properties of the metamaterial on the first surface of the tube may be defined via the above-referenced application step 804 and patterning step 806. The method 800 may further include providing a first flexible substrate 808. The method 800 may further include applying a metal structure/metal to the first flexible substrate 810. For instance, the first flexible substrate may be at least partially plated with the metal structure/metal. Further, the metal structure may include one or more layer(s)/material(s), such as metal layer(s)/material(s), dielectric layer(s)/material(s), and/or the like.

The method 800 may further include patterning the metal structure/metal on the first flexible substrate to form a metamaterial structure/metamaterial on the first flexible substrate 812. For instance, patterning the metal structure/metal to form a metamaterial structure/metamaterial on the first flexible substrate may be achieved via a chemical etching process, laser ablation, or the like. Metamaterial properties of the metamaterial on the first flexible substrate may be defined via the above-referenced application step 810 and patterning step 812. The method 800 may further include bonding the first flexible substrate to a second surface of the first tube to form a first waveguide feed of the multi-band waveguide reflector antenna feed 814. The method 800 may further include providing a second flexible substrate 816. The method 800 may further include applying a metal structure/metal to the second flexible substrate 818. For instance, the second flexible substrate may be at least partially plated with the metal structure/metal. Further, the metal structure may include one or more layer(s)/material(s), such as metal layer(s)/material(s), dielectric layer(s)/material(s), and/or the like. The method 800 may further include patterning the metal structure/metal on the second flexible substrate to form a metamaterial structure/metamaterial on the second flexible substrate 820. For instance, patterning the metal structure/metal to form a metamaterial structure/metamaterial on the second flexible substrate may be achieved via a chemical etching process, laser ablation, or the like. Metamaterial properties of the metamaterial on the second flexible substrate may be defined via the above-referenced application step 818 and patterning step 820. The method 800 may further include shaping the second flexible substrate to form a second tube 822. The method 800 may further include positioning the second tube at least partially around the first tube in a concentric array, thereby forming the second waveguide feed of the multi-band waveguide reflector antenna feed, said positioning including: selecting and establishing a relative radial positioning for the first tube and the second tube, wherein said relative radial positioning is selected and established based on desired frequency characteristics for the first waveguide feed and the second waveguide feed, the relative radial positioning providing a radial separation between the first tube and the second tube, thereby forming a cavity between the first tube and the second tube 824.

The method 800 may further include at least partially filling the cavity formed between the first tube and the second tube with a loading material for structurally interconnecting the first tube and the second tube and for maintaining the radial separation between the first tube and the second tube, thereby forming the multi-band waveguide reflector antenna feed 826. Alternatively, the method 800 may further include structurally interconnecting the first tube and the second tube via a plurality of support structures, thereby forming the multi-band waveguide reflector antenna feed, wherein said plurality of support structures maintains the radial separation between the first tube and the second tube 828.

The embodiments described in this disclosure indicate possible configurations for a multi-band waveguide reflector antenna feed/assembly/multi-band feed, and possible methods for providing same. An optimized multi-band waveguide reflector antenna feed configuration for a particular family of frequencies may utilize combinations of the above-described methods for creating metamaterial structures/creating metamaterials/creating metamaterial surfaces/depositing metal structures/depositing metals/forming metamaterial structures on the concentric tubes and for mechanically supporting those tubes. Further, the above-described configurations/methods may be extended to a greater number of surfaces to meet specific functional requirements for operating frequencies.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for producing a multi-band waveguide reflector antenna feed, comprising:

providing a first tube;

applying metal to a first surface of the first tube; and patterning the metal on the first surface of the first tube to form a metamaterial structure on the first surface of the first tube;

providing a first flexible substrate;

bonding the first flexible substrate to a second surface of the first tube to form a first waveguide feed of the multi-band waveguide reflector antenna feed.

2. The method as claimed in claim 1, further comprising: applying metal to the first flexible substrate.

3. The method as claimed in claim 2, further comprising: patterning the metal on the first flexible substrate to form a metamaterial structure on the first flexible substrate.

4. The method as claimed in claim 1, further comprising: providing a second tube.

5. The method as claimed in claim 4, further comprising: providing a second flexible substrate.

6. The method as claimed in claim 5, further comprising: applying metal to the second flexible substrate.

7. The method as claimed in claim 6, further comprising: patterning the metal on the second flexible substrate to form a metamaterial structure on the second flexible substrate.

8. The method as claimed in claim 7, further comprising: bonding the second flexible substrate to a surface of the second tube.

9. The method as claimed in claim 8, further comprising: positioning the first tube and the second tube in a concentric array, thereby forming a second waveguide feed of the multi-band waveguide reflector antenna feed, said positioning including: selecting and establishing a relative radial positioning for the first tube and the second tube, wherein said relative radial positioning is selected and established based on desired frequency characteristics for the first waveguide feed and the second waveguide feed, the relative radial positioning providing a radial separation between the first tube and the second tube, thereby forming a cavity between the first tube and the second tube.

10. The method as claimed in claim 9, further comprising: at least partially filling the cavity formed between the first tube and the second tube with a loading material for structurally interconnecting the first tube and the second tube and for maintaining the radial separation between the first tube and the second tube, thereby forming the multi-band waveguide reflector antenna feed.

11. The method as claimed in claim 9, further comprising: structurally interconnecting the first tube and the second tube via a plurality of support structures, thereby forming the multi-band waveguide reflector antenna feed, wherein said plurality of support structures maintains the radial separation between the first tube and the second tube.

* * * * *